US009121379B2

(12) United States Patent
Saito et al.

(10) Patent No.: US 9,121,379 B2
(45) Date of Patent: Sep. 1, 2015

(54) FUEL INJECTION VALVE

(71) Applicant: HITACHI AUTOMOTIVE SYSTEMS, LTD., Ibaraki (JP)

(72) Inventors: Takahiro Saito, Isesaki (JP); Nobuaki Kobayashi, Maebashi (JP); Hiroshi Ohno, Honjyo (JP); Atsushi Nakai, Isesaki (JP); Yoshio Okamoto, Omitama (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 325 days.

(21) Appl. No.: 13/660,168

(22) Filed: Oct. 25, 2012

(65) Prior Publication Data

US 2013/0206870 A1 Aug. 15, 2013

(30) Foreign Application Priority Data

Feb. 14, 2012 (JP) ..... 2012-029347

(51) Int. Cl.
*F02M 61/18* (2006.01)
*F02M 61/16* (2006.01)

(52) U.S. Cl.
CPC ..... *F02M 61/1806* (2013.01); *F02M 61/162* (2013.01); *F02M 61/184* (2013.01); *F02M 61/186* (2013.01); *F02M 61/1846* (2013.01); *F02M 61/1853* (2013.01)

(58) Field of Classification Search
CPC ..... F02M 61/1806; F02M 61/1833; F02M 61/184; F02M 61/1846; F02M 61/1853; F02M 61/186
USPC ..... 239/463, 468, 486, 487, 490, 491, 493, 239/494, 533.2, 533.3, 533.12, 584, 585.1, 239/585.4, 585.5, 596, 601
See application file for complete search history.

(56) References Cited

U.S. PATENT DOCUMENTS

| | | | | |
|---|---|---|---|---|
| 3,680,793 | A * | 8/1972 | Tate et al. | 239/468 |
| 6,142,390 | A * | 11/2000 | Nordstrom et al. | 239/490 |
| 6,405,945 | B1 * | 6/2002 | Dobrin | 239/463 |
| 6,811,104 | B2 | 11/2004 | Kobayashi et al. | |
| 6,854,670 | B2 * | 2/2005 | Sumisha et al. | 239/543 |

(Continued)

FOREIGN PATENT DOCUMENTS

| | | |
|---|---|---|
| CN | 102734020 | 10/2012 |
| JP | 2002-364496 | 12/2002 |
| JP | 2003-336561 | 11/2003 |

OTHER PUBLICATIONS

Search Report for Application No. GB1218938.7, issued on Mar. 7, 2013.

*Primary Examiner* — Ryan Reis
(74) *Attorney, Agent, or Firm* — Foley & Lardner LLP

(57) ABSTRACT

In a fuel injection valve, a pipe line through which fuel is uniformly caused to flow is supposed from a flow quantity of fuel flowing into each of communication passages which is communicated between a corresponding one of a plurality of swirl generating chambers and an opening section of a valve seat member and, if a diameter of the pipe line is assumed to be da and a diameter of each of injection holes is assumed to be d0, da/d0 is set such that a spray angle of fuel injected from each of the injection holes provides a desired spray angle and the communication passages and the injection holes are designed such that at least one of fuel sprays injected from the respective injection holes is contacted on any other fuel sprays at a lower position than a liquid film part.

17 Claims, 10 Drawing Sheets

(56) References Cited

U.S. PATENT DOCUMENTS

| | | | | |
|---|---|---|---|---|
| 6,874,710 | B2 | 4/2005 | Ishii et al. | |
| 7,100,848 | B2 | 9/2006 | Kobayashi et al. | |
| 2003/0141385 | A1* | 7/2003 | Xu | 239/463 |
| 2006/0202062 | A1 | 9/2006 | Mohamed et al. | |
| 2007/0175440 | A1 | 8/2007 | Lippert et al. | |

* cited by examiner

FUEL INJECTION VALVE

BACKGROUND OF THE INVENTION (1) Field of the Invention

The present invention relates to a fuel injection valve used for a fuel injection of an engine.

(2) Description of Related Art

A Japanese Patent Application First Publication (tokkai) No. 2003-336561 published on Nov. 28, 2003 (which generally corresponds to a U.S. Pat. No. 6,854,670 issued on Feb. 15, 2005) exemplifies a previously proposed fuel injection valve. In the previously proposed fuel injection valve, a passage plate and an injector plate are welded on a valve seat member. Then, side holes, transverse conduits, and swirl chambers are formed on the passage plate and fuel injection holes are formed within the injector plate.

SUMMARY OF THE INVENTION

The fuel injection valves are attached onto intake port(s) of the engine at various angles. It is necessary to suppress an adhesion of injected fuel onto the intake port of the engine by setting a fuel spray angle in accordance with its attachment angle of the fuel injection valve with respect to the intake port, when the fuel injection valve is attached onto the intake port at a suitable angle. However, in the technique described in the above-described Japanese Patent Application Publication No. 2003-336561, in order to obtain a desired fuel spray angle, the fuel spray angle is only set according to experiments using various shapes of the injector plate and the passage plate. Therefore, a great number of labor hours (manhours) are needed at a time of design stage.

it is, hence, an object of the present invention to provide an improved fuel injection valve which is capable of finding out a characteristic of a configuration of the fuel injection valve through which a desired fuel spray angle can be obtained and is capable of designing the fuel injection valve using the found out characteristic, and which is capable of suppressing a worsening of an atomization characteristic of fuel spray due to an interference between mutual sprays.

According to one aspect of the present invention, there is provided with a fuel injection valve comprising: a valve body slideably installed within the injection valve; a valve seat member having a valve seat on which the valve body is seated at a time of a valve closure and having an opening section at a downstream side of the valve seat member; a plurality of swirl generating chambers, each swirl generating chamber being configured to swirl fuel at an inner part of a corresponding one of the swirl generating chambers to provide a swirling force for fuel; a plurality of injection holes, each injection hole being formed on a bottom section of the corresponding one of the swirl generating chambers and penetrated to an external: and a communication passage configured to communicate between the corresponding one of the swirl generating chambers and the opening section of the valve seat member, wherein a pipe line through which fuel is uniformly caused to flow is supposed from a flow quantity of fuel flowing into each of the communication passages and, if a diameter of the pipe line is assumed to be da and a diameter of each of the injection holes is assumed to be d0, da/d0 is set such that a spray angle of fuel injected from each of the injection holes provides a desired spray angle and the communication passages and the injection holes are designed such that at least one of fuel sprays injected from the respective injection holes is contacted on any other fuel sprays at a lower position than a liquid film part.

DETAILED DESCRIPTION OF THE INVENTION

Hereinafter, reference is made to the accompanied drawings in order to facilitate a better understanding of the present invention.

First Embodiment

A fuel injection valve in a first preferred embodiment according to the present invention will be explained below.

[Structure of Fuel Injection Valve]

Figure 1:
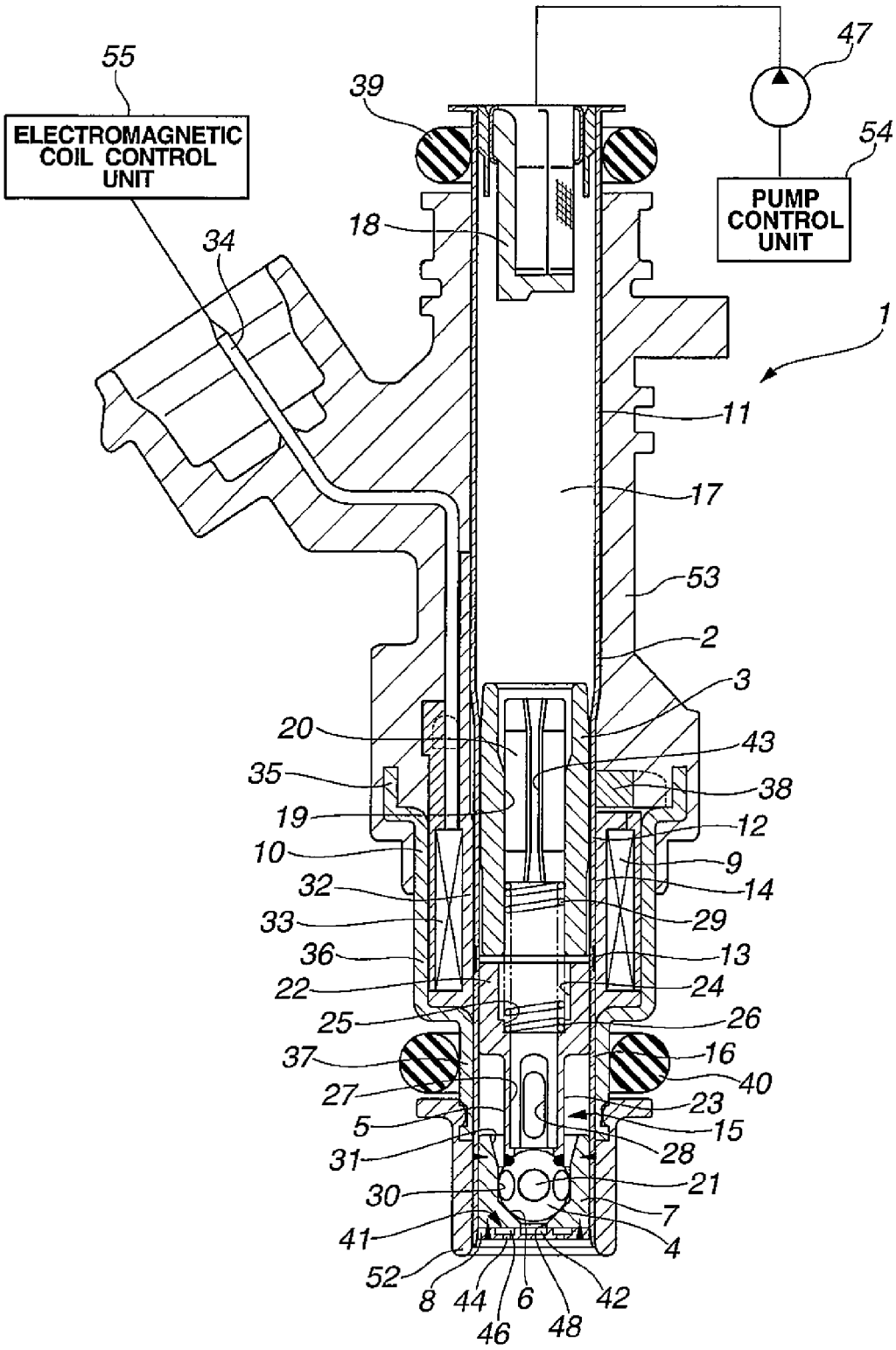
FIG. 1 is a cross sectional view of a fuel injection valve in a first preferred embodiment according to the present invention.

FIG. 1 shows an axial cross sectional view of fuel injection valve 1 in an axial direction of fuel injection valve 1. This fuel injection valve 1 is used for an automotive vehicle purpose gasoline engine and is a fuel injection valve for, so-called, a low pressure purpose. Fuel injection valve 1 includes: a magnetic material cylindrical body 3 housed within magnetic material cylindrical body 2; a valve body 4 which is capable of sliding in an axial direction of valve 1; a valve shaft 5 integrally formed within valve body 4; a valve seat member 7 having a valve seat 6 closed by means of valve body 4 at a time of a valve closure; a nozzle plate 8 having fuel injection holes through which fuel is injected at a time of the valve open; an electromagnetic coil 9 which slides valve body 4 in a valve open direction upon receipt of a power supply; and a yoke 10 which induces a magnetic flux line.

Magnetic material cylindrical body 2 is made of a metallic pipe and so forth formed of a magnetic metal material such as an electromagnetic stainless steel. Means of press working such as a deep drawing and of cutting work are used to form magnetic material cylindrical body 2 integrally in a stepped cylindrical shape as shown in FIG. 1.

Magnetic material cylindrical body 2 includes a large-diameter section 11 formed at one end section of body 2 and a small-diameter section 12 formed at the other end section of cylindrical body 2 and having a smaller diameter than large-diameter section 11. A partially thinned thin thickness section 13 is formed integrally on small-diameter section 12. Small-diameter section 12 is divided into: a core cylindrical body housing section 14 housing a core cylindrical body 3 located at one end side of thin thickness section 13, with thin thickness section 13 as a center; and a valve member housing section 16 housing a valve member 15 (valve body 4, valve shaft 5, and valve seat member 7) located at the other end side of thin thickness section 13 with respect to thin thickness section 13 as the center. Thin thickness section 13 is formed to enclose a gap portion between core cylindrical body 3 and valve shaft 5 in a state in which core cylindrical body 3 and valve shaft 5 are housed within magnetic material cylindrical body 2 as will be described later. Thin thickness section 13 serves to increase a magnetic resistance between core cylindrical housing section 14 and valve member housing section 16 and serves to magnetically interrupt between core cylindrical body 14 and valve member housing section 16.

A fuel passage 17 which is a supply passage of fuel to valve member 15 is formed within an inner diameter section of large-diameter section 11. A fuel filter 18 which filters fuel is disposed on the one end of large-diameter section 11. A pump 47 is connected to fuel passage 17. This pump 47 is controlled by means of a pump control unit 54.

Core cylindrical body 3 is formed in a cylindrical shape, includes a hollow section 19, and is pressed in core cylindrical body housing section 14 of magnetic material cylindrical body 2. A spring receiver 20 is housed within hollow section 19. Spring receiver 20 is fixed by means of press fitting. A fuel passage 43 which is axially penetrated through a center of spring receiver 20 is formed adjacent to spring receiver 20.

An outer profile of valve body 4 is formed in a substantially ball shape (a spherical body) and each fuel passage surface 21 cut in parallel to the axial direction of fuel injection valve 1 is formed on a peripheral surface of valve body 4. Valve shaft 5 includes a large diameter section 22 and a small diameter section 23 having an outer profile smaller than large diameter section 22.

Figure 2:
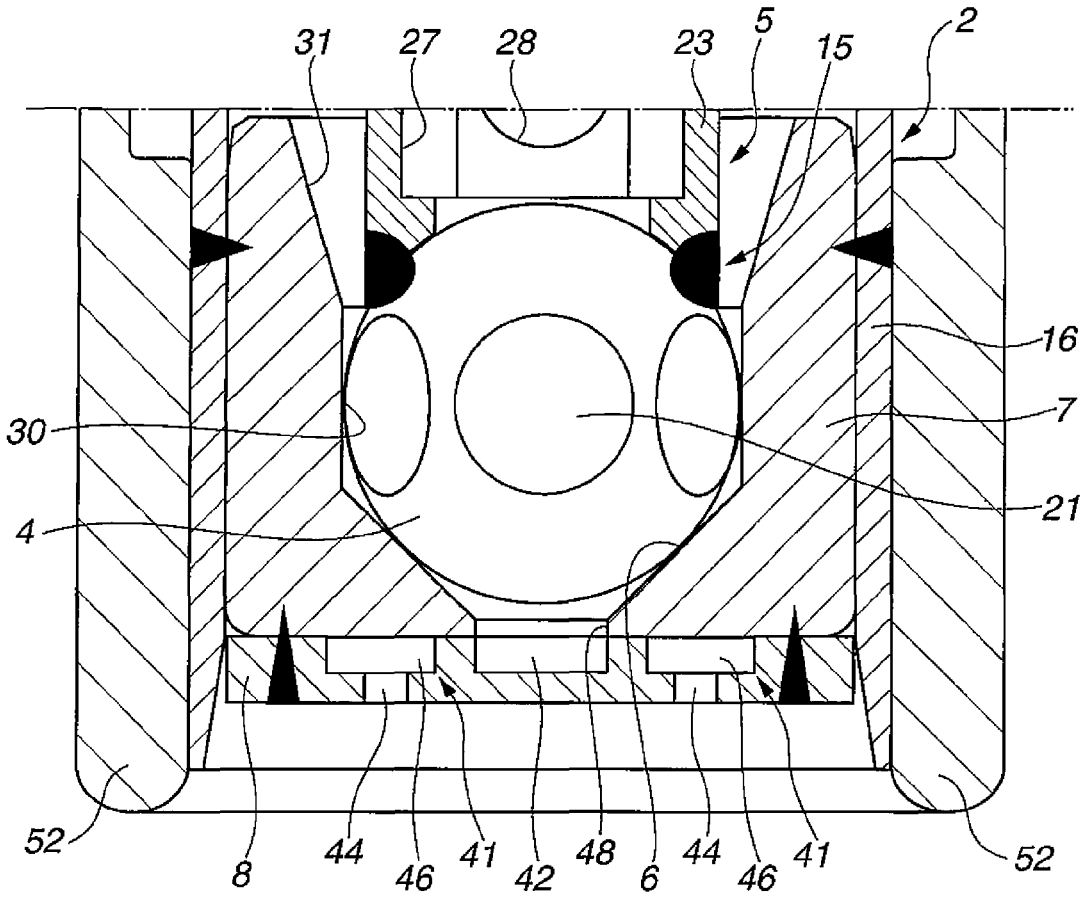
FIG. 2 is an expanded cross sectional view of a portion of the fuel injection valve in a vicinity to a nozzle plate of the fuel injection valve shown in FIG. 1.

Valve body 4 is welded integrally on a tip section of small-diameter section 23. In FIG. 2, black half-circles and black triangles denote welded locations. A spring inserting hole 24 is pierced through an end section of large diameter section 22. A spring seat section 25 is formed on a bottom section of spring inserting hole 24 and has a diameter smaller than spring inserting hole 24 and a spring receiving section 26 in a stepwise form is formed on the bottom section of spring inserting hole 25. A fuel passage hole 27 is formed at an end section of small diameter section 23. This fuel passage hole 27 is communicated with spring inserting hole 24. A penetrated fuel flow-out hole 28 is formed within an outer periphery of small-diameter section 23 and fuel passage hole 27. Valve seat member 7 includes: a valve seat 6 in a substantially truncated cone shape (in cross section); a valve body holding hole 30 formed at the substantially same diameter as the diameter of valve body 4 and located at a more one end side than valve seat 6; an upstream side opening section 31 whose diameter is formed to be larger as valve seat member 7 goes from valve body holding hole 30 toward the one end section; and a down-stream side opening section 48 opened toward the other end section of valve seat 6 which is opposite to upstream opening section 31.

Valve shaft 5 and valve body 4 are axially slideably housed within magnetic material cylindrical body 2. A coil spring 29 is interposed between spring receiving section 26 of valve shaft 5 and spring receiving section 20 to bias valve shaft 5 and valve body 4 toward the other end side of valve seat member 7. Valve seat member 7 is inserted into magnetic material cylindrical body 2 and fixed onto magnetic material cylindrical body 2 by means of welding. Valve seat 6 is formed in such a way that its diameter becomes smaller as valve seat 6 goes from valve body holding hole 30 toward down-stream opening section 48 at an inclination angle of 45°. When the valve is closed, valve body 4 is seated on valve seat 6.

Electromagnetic coil 9 is inserted and fitted into the outer periphery of core cylindrical body 3 of magnetic material cylindrical body 2. That is to say, electromagnetic coil 9 is disposed on the outer periphery of core cylindrical body 3. Electromagnetic coil 9 includes: a bobbin 32 formed of a resin material; and a coil 33 wound around this bobbin 32. Coil 33 is connected to an electromagnetic coil control unit 55 via a connector pin 34.

Electromagnetic coil control unit 55 turns on the power supply to coil 33 of electromagnetic coil 9 to open fuel injection valve 1 in accordance with a timing at which fuel is injected toward a combustion chamber side calculated on a basis of an information from a crank angle sensor detecting a crank angle.

A yoke 10 includes a hollow penetrating hole and is constituted by: a large diameter section 35 formed on an one end opening side of yoke 10; a middle diameter section 36 having a diameter smaller than large diameter section 35; and a small diameter section 37 having a diameter smaller than middle diameter section 36 and formed at the other end opening aide. Small diameter section 37 is fitted into the outer periphery of valve member housing section 16. Electromagnetic coil 9 is housed within the inner periphery of middle diameter section 36. A linkage core 38 is disposed on the inner periphery of large diameter section 35.

Linkage core 38 is formed in a substantially letter C shape made of a magnetic metallic material.

Yoke 10 is connected to magnetic material cylindrical body 2 on large diameter section 35 via small diameter section 37 and linkage core 38. That is to say, both end sections of electromagnetic coil 9 are magnetically connected to magnetic material cylindrical body 2. A tip section of the other end side of yoke 10 holds an O ring 40 to connect fuel injection valve 1 to an intake port of the engine. In addition, a protector 52 to protect the tip of the magnetic material cylindrical body is attached on the tip of the other end side of yoke 10.

When the power is supplied to electromagnetic coil 9 via a connector pin 34 to generate a magnetic field, valve body 4 and valve shaft 5 are opened against a biasing force of coil spring 29 according to a magnetic force of the magnetic field.

As shown in FIG. 1 of fuel injection valve 1, a majority part of fuel injection valve 1 is covered with a resin cover 53. Parts covered with resin cover 53 include: a position from a part excluding one end section of large diameter section 11 of magnetic material cylindrical body 2 to a position of small diameter section 37 at which electromagnetic coil 9 is mounted, a position between electromagnetic coil 9 and middle section 36 of yoke 10, a position between electromagnetic coil 9 and middle diameter section 36 of yoke 10, a position between the outer periphery of linkage core 38 and large diameter section 35, the outer periphery of large diameter section 35, the outer periphery of middle diameter section 36, and the outer periphery of a connector pin 34. Resin cover 53 is opened at the tip section of connector pin 34 through which a connector of electromagnetic coil control unit 55 is inserted. An O ring 39 is disposed on the outer periphery of the one end section of magnetic material cylindrical body 2 and an O ring 40 is disposed on the outer periphery of small diameter section 37 of yoke 10. A nozzle plate 8 is welded on the other end side of valve seat member 7. This nozzle plate 8 includes: a plurality of swirl chambers 41 providing a swirl (a swirling flow) for fuel; a center chamber 42 distributing fuel over each swirl chamber 41; and (fuel) injection holes 44 through which fuel for which the swirl generated within a corresponding one of the swirl chambers 41 is provided is injected.

[Structure of Nozzle Plate]

Figure 3:
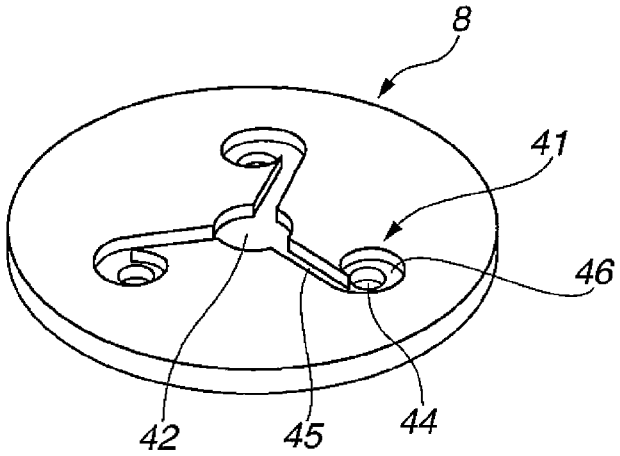
FIG. 3 is a perspective view of the nozzle plate of the fuel injection valve shown in FIG. 1.

FIG. 2 is an expanded cross sectional view of a part of fuel injection valve 1 in a vicinity to nozzle plate 8 of fuel injection valve 1. FIG. 3 shows a perspective view of nozzle plate 8 in the first embodiment. The structure of nozzle plate 8 will be described using FIGS. 2 and 3. Swirl chambers 41 and center chamber 42 are formed on one end (side) surface of nozzle plate 8 (as shown in FIG. 3). Center chamber 42 is formed in a bottomed circular recess shape in a vicinity to the center of nozzle plate 8. Three swirl chambers 41 are formed and each of swirl chambers 41 is constituted by a communication passage 45 and a swirl generating chamber 46. Each communication passage 45 is connected together in a vicinity to a center of nozzle plate 8 and center chamber 42 is formed at a connection portion of each communication passage 45. Swirl generating chamber 46 is formed on a tip section of communication passage 45. Communication passage 45 is connected to corresponding swirl generating chamber 46 along a tangential line direction of swirl generating chamber 46. Communication passage 45 is formed in the bottomed recess shape having the inner side surface and the bottom section and its cross sectional area is formed in a swirl (or a spiral) configuration. Each fuel injection hole 44 which is a penetrating hole is formed on a bottom section of swirl generating chamber 46.

[Details of Each Swirl Chamber and Each Fuel Injection Hole]

Figure 4:
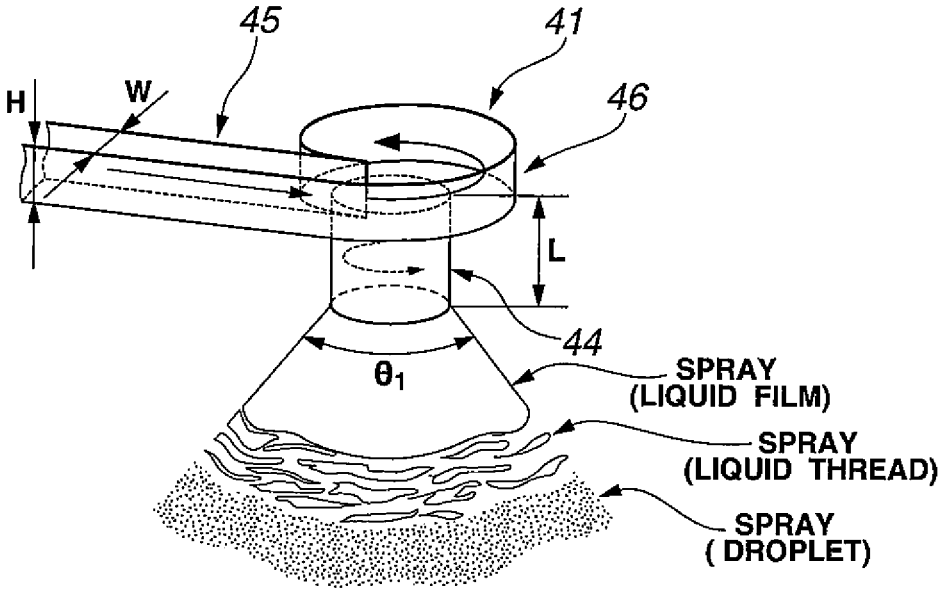
FIG. 4 is a perspective view of a swirl chamber and a connected fuel injection hole of the fuel injection valve shown in FIG. 1.
Figure 5:
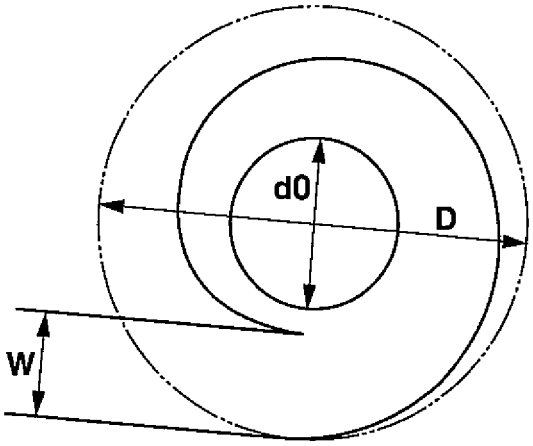
FIG. 5 is a rough plan view of the swirl chamber and the connected fuel injection hole of the fuel injection valve shown in FIG. 1.

FIG. 4 is a perspective view of a representative swirl chamber 41 and corresponding (connected) fuel injection hole 44. FIG. 5 is a rough plan view of representative swirl chamber 41 and fuel injection hole 44 shown in FIG. 4.

As shown in FIG. 4, suppose that a width of communication passage 45 is W, a height is H, an axial length of fuel injection hole 44 is L. As shown in FIG. 5, suppose that a diameter of representative swirl generating chamber 46 is D, a diameter of representative fuel injection hole 44 is d0. It should be noted that a diameter of swirl generating chamber 46 is set to be a diameter D when a circle based on a curvature of a part of an inner wall of swirl generating chamber 46 which is connected to communication passage 45 is formed. In addition, an equivalent flow quantity diameter of communication passage 45 is assumed as da. Fuel is not uniformly caused to flow within communication passage 45 but a flow quantity of fuel at the proximity of the inner wall of communication passage 45 is set to be smaller than the flow quantity of the center.

Equivalent flow quantity diameter da of communication passage 45 is the diameter of a pipe line supposing the pipe line in which fuel is uniformly caused to flow from the flow quantity flowing through communication passage 45 and can be determined from the following equation:

$$da = \sqrt{4WH/\pi}$$

Swirl chamber 41 is so designed as to be in accordance with a fuel injection spray angle θ1 to be desired to be set. It should, herein, be noted that fuel injection spray angle θ1 is a spreading angle of fuel spray as appreciated from FIG. 4.

At this time, a fuel spray state is defined using FIG. 4. A liquid film (or liquid membrane) state of fuel spray is a state in which fuel is in a film (membrane) state on a spray surface in a substantially hollow conical shape formed immediately after fuel is injected from corresponding fuel injection hole 44. A fuel liquid thread state of fuel spray indicates a state in which fuel spray which has been the film state is gradually started to be disrupted. A fuel droplet state of fuel spray indicates a state in which a further disruption is advanced than the liquid thread state and fuel is further disrupted in a granulated.

Figure 6A:
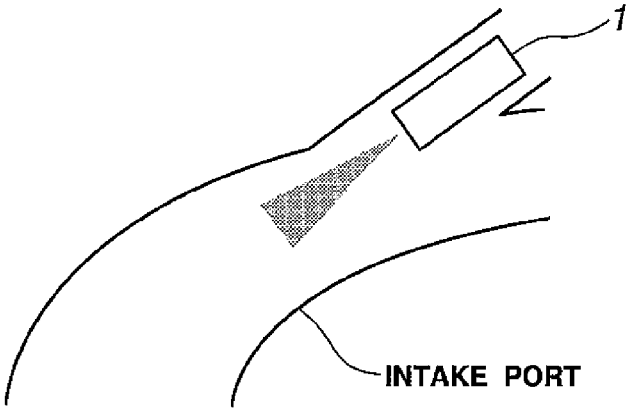
FIGS. 6A, 6B, and 6C are explanatory views of examples of an attachment angle of the fuel injection valve to an intake port of an engine in a case of the first embodiment shown in FIG. 1.
Figure 6B:
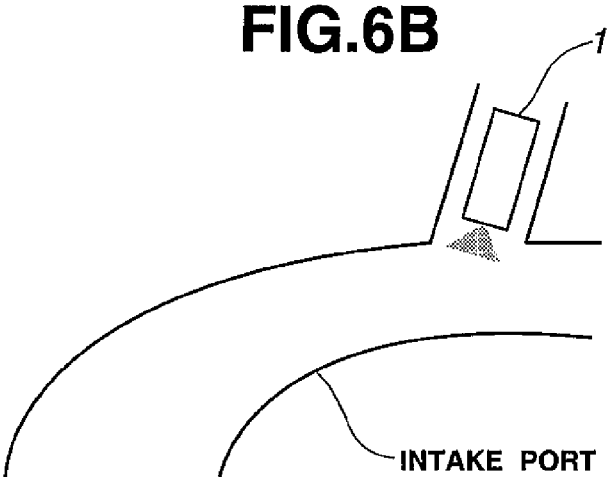
Figure 6C:
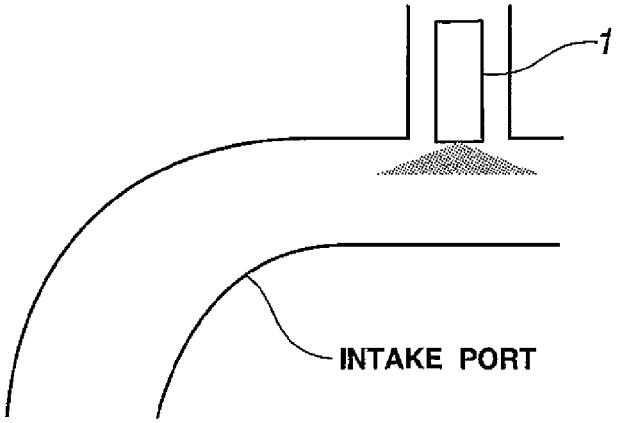

FIGS. 6A, 6B, and 6C show explanatory views for explaining examples of attaching fuel injection valve 1 onto the intake port of the engine.

Figure 7:
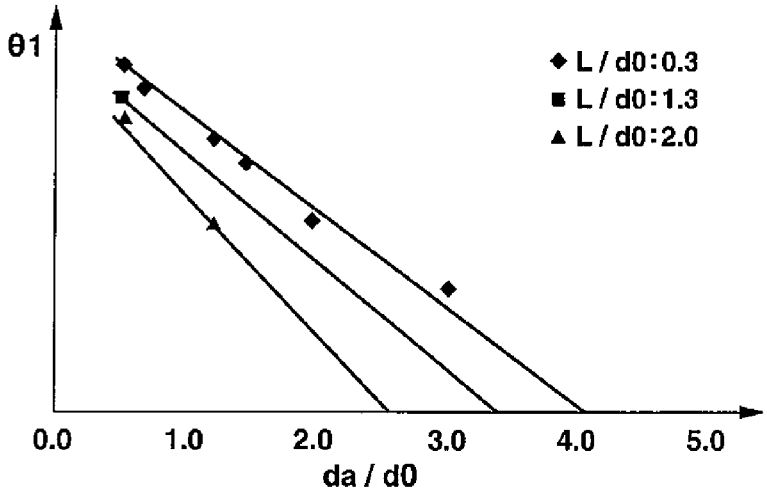
FIG. 7 is a graph representing a relationship among da/d0, L/d0 and a fuel spray angle θ1 in the case of the first embodiment shown in FIG. 1.

When an attachment angle of fuel injection valve 1 to the intake port is relatively shallow as shown in FIG. 6A, the fuel spray angle can be narrowed (be made small) so that a quantity of attachment (adherence) of fuel injected onto the surrounding intake port can be suppressed. On the other hand, even when the attachment angle of fuel injection valve 1 to the intake port is relatively deep (as shown in FIGS. 6B and 6C), the fuel spray angle can be widened (be increased) so that the attachment of injected fuel onto the surrounding intake port can be suppressed. FIG. 7 shows a graph representing a relationship among da/d0, L/d0, and fuel spray angle θ1.

As shown in FIG. 7, da/d0 and fuel spray angle θ1 have a negative correlation and can be approximated to a linear characteristic.

If da/d0 is the same (value), fuel spray angle θ1 is made smaller (narrower) (becomes smaller) as L/d0 becomes larger. da/d0 and L/d0 are set such that the spray angle of fuel provides a desired fuel spray angle in accordance with the attachment angle of fuel injection valve 1 to the intake port. Even if the spray angle is the same fuel spray angle θ1, a plurality of combinations of da/d0 and L/d0 can be selected. However, an appropriate selection in accordance with other design methods can be made for this selection combination.

In addition, a worsening suppression of an atomization characteristic of fuel spray may be adjusted through a set of a length of an interval between injection holes together with a design of the spray angle according to da/d0 and L/d0. This may appropriately be selected in accordance with the other design method and a dimension limitation. It should be noted that the dimension limitation includes: a range limitation in which communication passage 45, swirl generating chamber 46, and fuel injection hole 44 can be arrayed and a limitation value of a plate thickness due to a material strength and so forth.

[Action]

(Flow of Fuel at a Time of Valve Closure)

When the power is not supplied to coil section 33 of electromagnetic coil 9, coil spring 29 biases valve shaft 5 toward the other end side of valve seat member 7 to seat valve body 4 on valve seat 6. Therefore, a spatial interval between valve body 4 and valve seat 6 is closed so that no fuel is supplied to nozzle plate 8 side.

(Flow of Fuel at a Time of Valve Open)

The stream of fuel at a time of valve open will be explained using FIG. 4.

When the power is supplied to coil section 33 of electromagnetic coil 9, valve shaft 5 is pulled up toward the one end side of valve seat member 7 according to the electromagnetic force against the biasing force of coil spring 29. Therefore, the spatial interval between valve body 4 and valve seat 6 is released (open) so that fuel is supplied to nozzle plate 8 side.

Fuel supplied to nozzle plate 8 enters center chamber 42 and collides with the bottom section of center chamber 42. Thus, fuel stream is converted from an axial flow to a radial flow and is caused to flow into each communication passage 45. Since communication passage 45 is connected along the tangential line direction of corresponding one of swirl generating chambers 46, fuel passed through communication passage 45 is swirled along an inner side surface of swirl generating chamber 46. A swirl force is given to fuel in swirl generating chamber 46 so that fuel having the swirling force is injected while fuel is swirling along a side wall section of fuel injection hole 44. Therefore, fuel injected from each of fuel injection holes 44 is scattered along the tangential line direction of fuel injection hole 44. Fuel spray immediately after injection from each fuel injection hole 44 is spread in the conical shape in the thin liquid film state by means of an edge portion of the opening section of fuel injection hole 44. Thereafter, fuel in the state of the liquid film is separated to provide an atomized liquid droplet. Therefore, an atomization of fuel can be promoted. The improvement in a combustion efficiency is made so that a generation of nitrogen oxide (NOx) at a time of cold start (engine start state at the time of (under) a low temperature) can be reduced.

(Setting of Fuel Spray Angle)

As described above, in order to suppress the adhesion of injected fuel onto the intake port, it is necessary to set fuel spray angle θ1 in accordance with the attachment angle of fuel injection valve 1 to the intake port. However, in the previously proposed fuel injection valve as described in the BACKGROUND OF THE INVENTION, various types of the swirl chambers are prepared so that fuel spray angle θ1 is set only through many experiments and, thus, a great number of labor hours (man-hours) are needed to be consumed at the time of the design of the fuel injection valve.

At the present time, fuel spray angle θ1 shown in FIG. 7 has apparently the negative correlation to da/d0 and this can be approximated to the linear characteristic.

Since da/d0 can be set to the desired fuel injection angle θ1 using this characteristic, the development labor hour (man-hour) of fuel injection valve 1 can be suppressed. In addition, the characteristic of fuel spray angle θ1 to da/d0 can be set for each L/d0 (L/d0 is 0.3, L/d0 is 1.3, and L/d0 is 2.0). Therefore, a design degree of freedom can be increased. In addition, when the atomization characteristic of spray is taken into consideration, each fuel injection hole 44 can be set viewing a balance with the spray angle so as to suppress the contact of the liquid film parts of the respective sprays.

[Effect]

Effects that fuel injection valve 1 can exhibit in the first embodiment will be described below.

(1) In fuel injection valve 1 including slideably disposed valve body 4, valve seat member 7 having valve seat 6 on which valve body 4 is seated and downstream opening section 48 located at the downstream side of valve seat member 7, swirl generating chambers 46 in the inner side of which fuel is swirled to provide the swirling force for fuel, fuel injection holes 44 formed on the bottom section of swirl generating chambers 46 and penetrated to an external, and communication passages 45 each of which communicates between a corresponding one of swirl generating chambers 46 and downstream opening section 48 of valve seat member 7, da/d0 is set so that the spray angle of fuel injected from each fuel injection hole 44 (fuel spray angle θ1) provides the desired spray angle when the diameter of the pipe line is assumed to be da, the diameter of fuel injection hole 44 (injection hole) is assumed to be d0, when the pipe line into which fuel is uniformly caused to flow is supposed from a flow quantity of fuel within communication passage 45, communication passages 45 and fuel injection holes 44 are accordingly designed.

Hence, since da/d0 can be set to the desired fuel spray angle θ1, the development man-hour for fuel injection valve 1 can be suppressed.

(2) The characteristic of desired fuel spray angle θ1 to to da/d0 is the linear characteristic.

Hence, da/d0 with respect to desired fuel spray angle θ1 at the time of the design stage is easily set so that the development of fuel injection valve 1 can be facilitated.

(3) When length of each injection hole is L, the is characteristic of fuel spray angle θ1 to da/d0 is set for each of L/d0.

Hence, the degree of freedom of design of communication passages 45 and fuel injection holes 44 can be increased. (4) The interval (distance) among (or between) fuel spray holes 44 is set to an interval at which the contact of the mutual sprays in the liquid film parts can be suppressed on a basis of fuel spray angle θ1 that can easily be designed with items of (1) through (3) taken into account. Therefore, the degree of freedom of design which suppresses the worsening of the characteristic of atomization of spray can be increased.

Other Embodiments

Hereinafter, the present invention has been explained on a basis of first preferred embodiment according to the present invention. Specific structures of the present invention are not limited to the above-described first preferred embodiment. Various modifications and design changes can be made without departing from the scope and spirit of the present invention.

(Modification of the Number of Swirl Generating Chamber)

In fuel injection valve 1 in the first embodiment, three swirl chambers 41 are formed. However, the present invention is not limited. The number of swirl chambers 41 may appropriately be varied according to the design of a fuel injection quantity.

Figure 19:
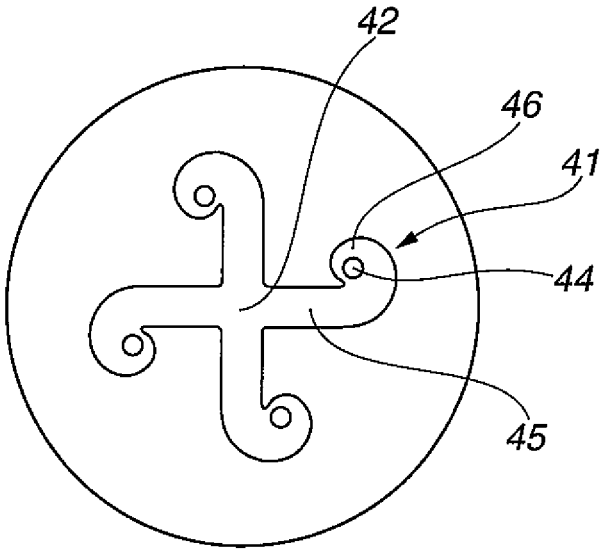
FIG. 19 is a plan view of the nozzle plate of the fuel injection valve in an eleventh preferred embodiment of the fuel injection valve.
Figure 20:
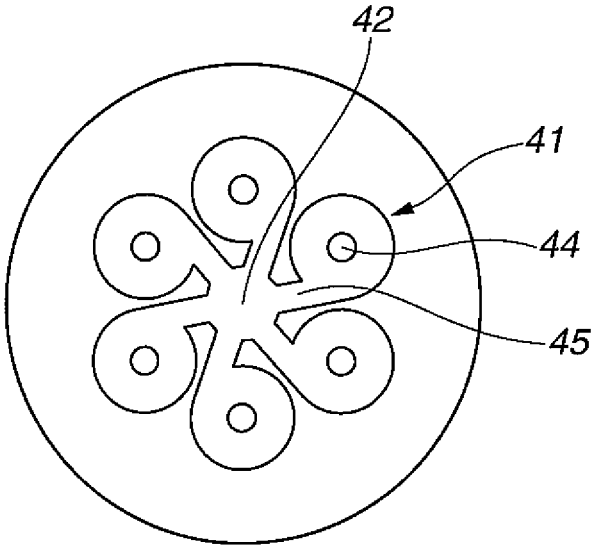
FIG. 20 is a plan view of the nozzle plate of the fuel injection valve in a twelfth preferred embodiment of the fuel injection valve.

For example, four or sixth swirl chambers 41 may be formed as shown in FIGS. 19 and 20.

Figure 8:
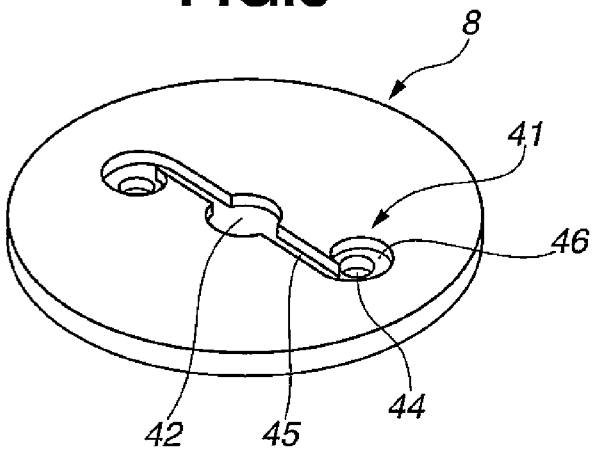
FIG. 8 is a perspective view of the nozzle plate in a second preferred embodiment of the fuel injection valve.

FIG. 8 shows a perspective view of nozzle plate 8. For example, two swirl chambers 41 may be formed as shown in FIG. 8.

(Modification of Center Chamber)

Center chamber 42 is formed in the circular recess shape in the first embodiment of fuel injection valve 1. However, the shape of center chamber 42 may be modified.

Figure 9:
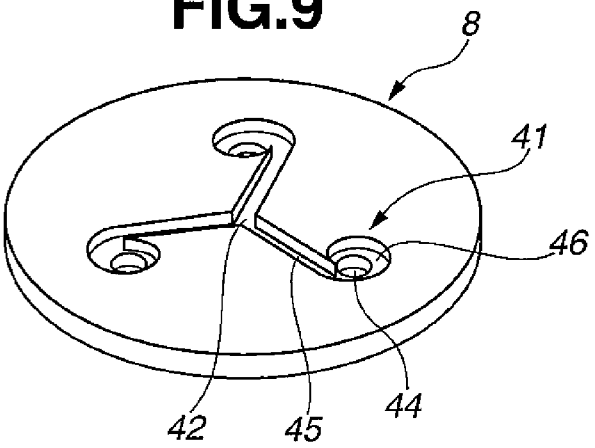
FIG. 9 is a perspective view of the nozzle plate in a third preferred embodiment of the fuel injection valve.

FIG. 9 is a perspective view of nozzle plate 8 when three swirl chambers 41 are formed. As in a case of FIG. 9, center chamber is merely in the recess shape and is continued to corresponding communication passages 45.

Figure 10:
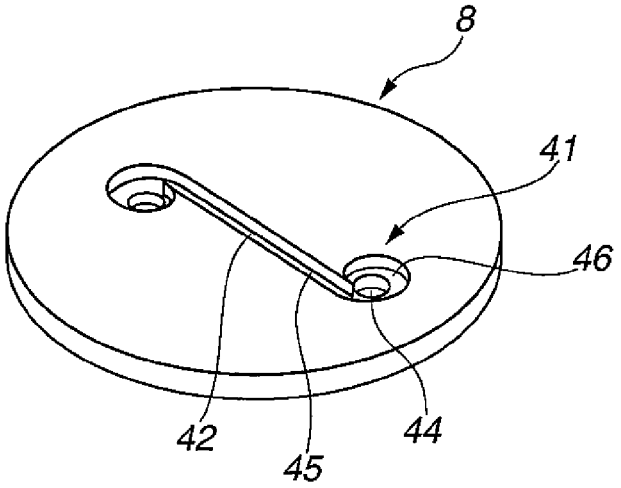
FIG. 10 is a perspective view of the nozzle plate in a fourth preferred embodiment of the fuel injection valve.

FIG. 10 is a perspective view of nozzle plate 8 when two swirl chambers 41 are formed. For example, as shown in FIGS. 9 and 10, communication passages 45 are directly connected to each other and their connection portion may be center chamber 42.

(Modification of Nozzle Plate)

In the case of fuel injection valve 1 in the first embodiment, all of center chamber 42, swirl chambers 41, and fuel injection holes 44 are formed within nozzle plate 8. Alternatively, these elements may not be needed to be formed within nozzle plate 8.

Figure 11:
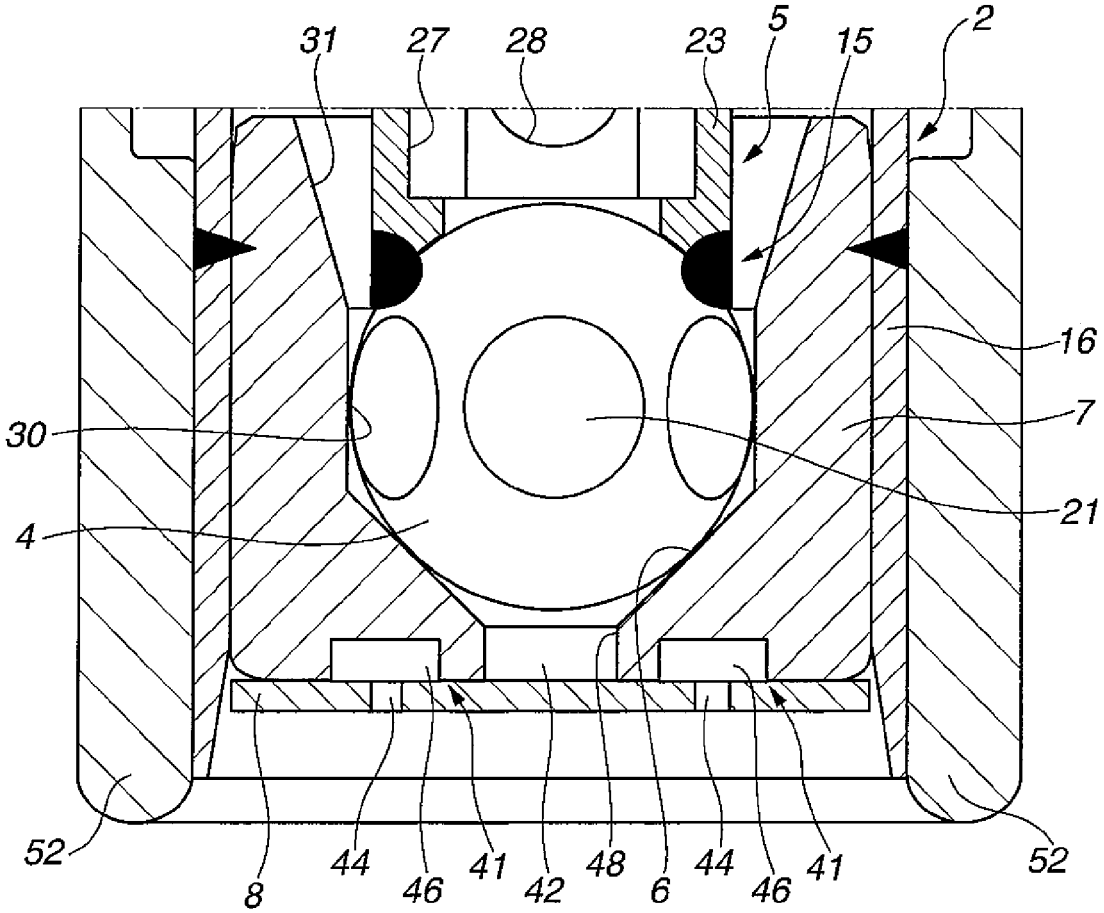
FIG. 11 is an expanded cross sectional view of a part of the fuel injection valve in a vicinity to the nozzle plate of the fuel injection valve in a fifth preferred embodiment of the fuel injection valve.

FIG. 11 shows an expanded cross sectional view of the part of fuel injection valve 1 in the proximity to nozzle plate 8 of fuel injection valve 10.

Figure 12:
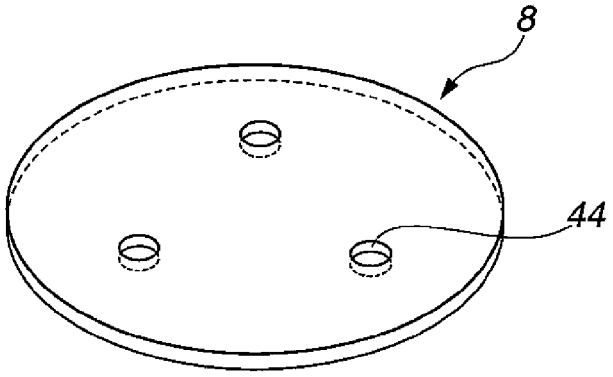
FIG. 12 is a perspective view of the nozzle plate in a sixth preferred embodiment of the fuel injection valve.

FIG. 12 shows a perspective view of nozzle plate 8. For example, as shown in FIGS. 11 and 12, center chamber 42 and swirl chamber 41 may be formed in the other end side of valve seat member 7 and only fuel injection holes 44 may be penetrated through nozzle plate 8.

(Addition of Intermediate Plate)

In the case of fuel injection valve 1 in the first embodiment, center chamber 42, swirl chambers 41, and fuel injection holes 44 are formed within nozzle plate 8. However, the present invention is not limited to this. All of these elements may not be formed within nozzle plate 8.

Figure 13:
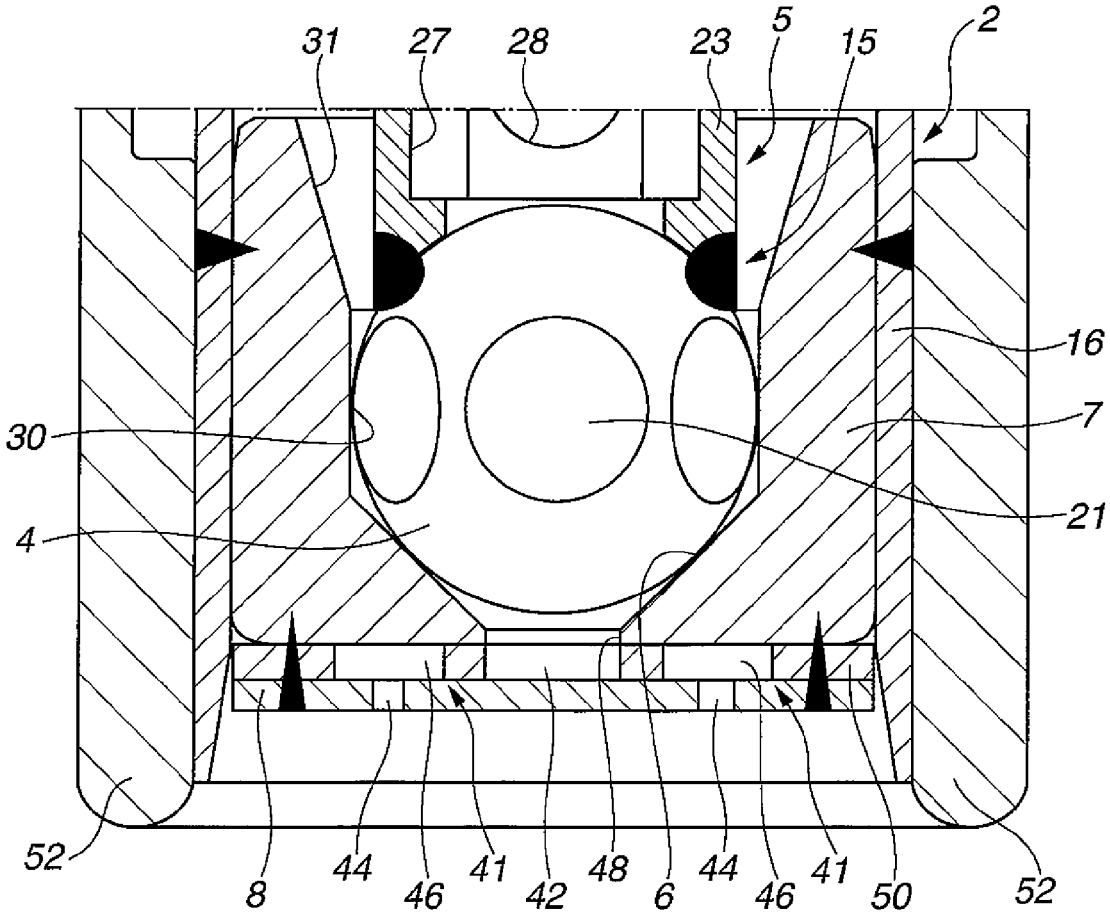
FIG. 13 is an expanded cross sectional view of the part of the fuel injection valve in a vicinity to the nozzle plate in a seventh preferred embodiment of the fuel injection valve.
Figure 14:
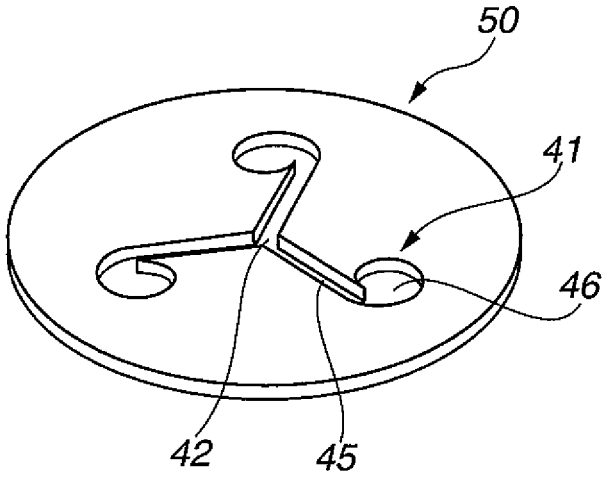
FIG. 14 is a perspective view of an intermediate plate in the seventh preferred embodiment of the fuel injection valve shown in FIG. 13.
Figure 15:
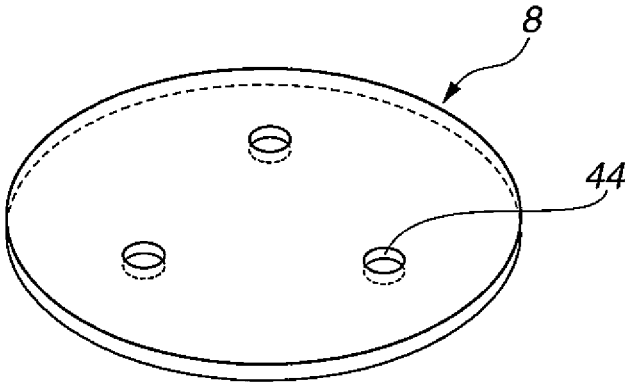
FIG. 15 is a perspective view of the nozzle plate in the seventh preferred embodiment of the fuel injection valve shown in FIG. 13.

FIG. 13 shows an expanded cross sectional view of the part of fuel injection valve 1 in the proximity to nozzle plate 8 in another preferred embodiment of fuel injection valve 1. FIG. 14 is a perspective view of an intermediate plate 50 in the case of FIG. 13. FIG. 15 is a perspective view of nozzle plate 8 in the case of FIGS. 13 and 14. For example, as shown in FIGS. 13 through 15, center chamber 42 and swirl chamber 41 may be formed within intermediate plate 50 and only fuel injection hole 44 may be penetrated through nozzle plate 8.

(Modification of Swirl Generating Chambers)

In fuel injection valve 1 in the first embodiment, as the shape of swirl generating chamber 46, each swirl generating chamber of spiral shape as shown in FIG. 5 is shown.

However, the present invention is not limited to this. Each swirl generating chamber 46 may be formed in a substantially circular shape to provide the swirling force for fuel.

Figure 16:
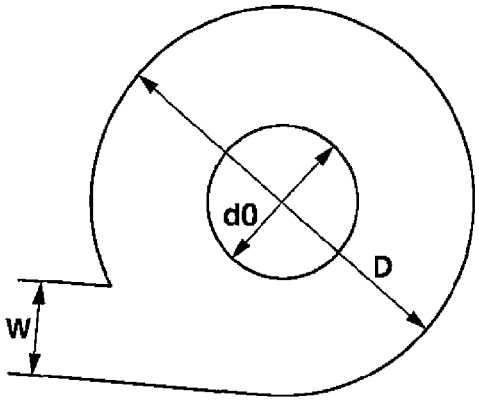
FIG. 16 is a rough perspective view of the swirl chamber and the fuel injection hole of the fuel injection valve in an eighth preferred embodiment of the fuel injection valve.
Figure 17:
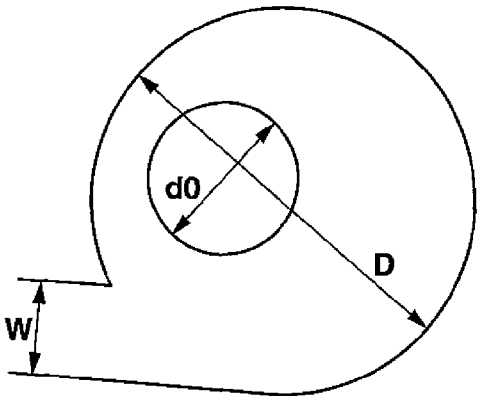
FIG. 17 is a rough perspective view of the swirl chamber and the fuel injection hole of the fuel injection valve in a ninth preferred embodiment of the fuel injection valve.

FIGS. 16 and 17 are plan views of still another embodiment of swirl chambers 41 and fuel injection holes 44. For example, as shown in FIG. 16, swirl generating chamber 45 may be formed in a substantially perfect round shape. In addition, as shown in FIG. 17, the position of each fuel injection hole 44 may be shifted from a center of corresponding swirl generating chamber 46.

(Modification of Communication Passage)

Each communication passage 45 is formed as shown in FIG. 5, in fuel injection valve 1 in the first embodiment. However, the present invention is not limited to this. Communication passage 45 may be modified if the fuel spray angle in accordance with the attachment angle of fuel injection valve 1 to intake port is obtained.

Figure 18:
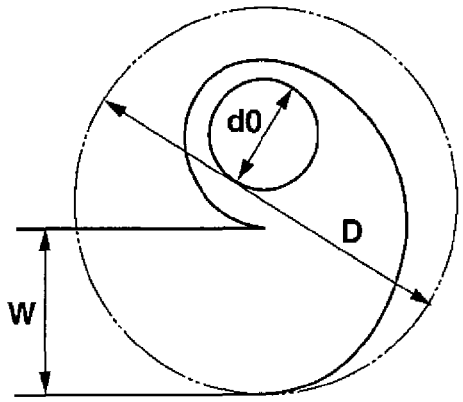
FIG. 18 is a rough perspective view of the swirl chamber and the fuel injection hole of the fuel injection valve in a tenth preferred embodiment of the fuel injection valve.

FIG. 18 shows a plan view of representative swirl chamber 41 and corresponding fuel injection hole 44. For example, width W of communication passage 44 may be widened (increased) as compared with the case in the first preferred embodiment, as shown in FIG. 18.

It should be noted that each of the embodiments can be combined and swirl chambers 41 and communication passages 45 are applicable to nozzle plate 8, valve seat member 7, or intermediate plate 50 in each embodiment.

This application is based on a prior Japanese Patent Application No. 2012-029347 filed in Japan on Feb. 14, 2012. The entire contents of this Japanese Patent Application No. 2012-029347 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A fuel injection valve comprising:

a valve body slidably installed within the injection valve;

a valve seat member having a valve seat on which the valve body is seated at a time of a valve closure and having an opening section at a downstream side of the valve seat member;

a plurality of swirl generating chambers, each swirl generating chamber being configured to swirl fuel at an inner part of a corresponding one of the swirl generating chambers to provide a swirling force for fuel;

a plurality of injection holes, each injection hole being formed on a bottom section of the corresponding one of the swirl generating chambers and penetrated to an external; and a communication passage configured to communicate between the corresponding one of the swirl generating chambers and the opening section of the valve seat member, wherein a pipe line through which fuel is uniformly caused to flow is supposed from a flow quantity of fuel flowing into each of the communication passages and, if a diameter of the pipe line is assumed to be da and a diameter of each of the injection holes is assumed to be d0, da/d0 is set such that a spray angle of fuel injected from each of the injection holes provides a desired spray angle and the communication passages and the injection holes are designed such that at least one of fuel sprays injected from the respective injection holes is contacted on any other fuel sprays at a lower position than a liquid film part without contact of the fuel sprays injected from the respective injection holes on the liquid film parts of any other fuel sprays, wherein $$da = \sqrt{4WH/\pi}$$

wherein W denotes a width of each of the communication passages and H denotes a height of each of the communication passages.

2. The fuel injection valve as claimed in claim 1, wherein a characteristic of the spray angle with respect to da/d0 is a linear characteristic.

3. The fuel injection valve as claimed in claim 2, wherein, if a length of each of the injection holes is assumed as L, the characteristic of the spray angle with respect to da/d0 is set for each of L/d0.

4. The fuel injection valve as claimed in claim 1, wherein da/d0 is set such that the spray angles of fuel injected from the respective injection holes provide such spray angles that the liquid film parts of the respective sprays injected from the mutual injection holes are not contacted on one another.

5. The fuel injection valve as claimed in claim 1, wherein each of the swirl generating chambers and the communication passages is formed within the valve seat member.

6. The fuel injection valve as claimed in claim 1, wherein a nozzle plate is coupled to one end side of the valve seat member and each of swirl generating chambers and the communication passages is formed within an intermediate plate interposed between the valve seat member and the nozzle plate.

7. The fuel injection valve as claimed in claim 1, wherein a nozzle plate is coupled to one end side of the valve seat member and each of the swirl generating chambers is formed within the nozzle plate and each of the injection holes is penetrated through the nozzle plate to the external.

8. The fuel injection valve as claimed in claim 1, wherein a diameter of each of the swirl generating chambers is a diameter of a circle which is formed on a basis of a curvature of an inner wall of a part of each of the swirl generating chambers to which a corresponding one of the communication passages is connected.

9. The fuel injection valve as claimed in claim 8, wherein each of the swirl generating chambers and the corresponding one of the communication passages constitute a swirl chamber and each swirl chamber is designed in accordance with the desired fuel spray angle.

10. The fuel injection valve as claimed in claim 8, wherein, if da/d0 is the same value, the desired spray angle becomes smaller as L/d0 becomes larger.

11. The fuel injection valve as claimed in claim 10, wherein da/d0 and L/d0 are set such that the spray angle from each of the injection holes provides the desired spray angle in accordance with an angle of the fuel injection valve with respect to an intake port of an engine.

12. The fuel injection valve as claimed in claim 9, wherein the valve body is formed in a spherical body and the valve seat member is formed in a truncated cone shape in cross section and a nozzle plate is disposed on one end side of the valve seat member at a downstream side of the valve seat member, the swirl chambers and a center chamber in a bottomed recess shape being formed on one end surface of the nozzle plate and the injection holes being penetrated through the nozzle plate to the external.

13. The fuel injection valve as claimed in claim 9, wherein the valve body is formed in a spherical body and the valve seat member is formed in a truncated cone shape in cross section and a nozzle plate is disposed on one end side of the valve seat member at a downstream side of the valve seat member, the swirl chambers and a center chamber in a bottomed recess shape being formed on one end surface of the valve seat member and the injection holes being penetrated through the nozzle plate to the external.

14. The fuel injection valve as claimed in claim 9, wherein the valve body is formed in a spherical body and the valve seat member is formed in a truncated cone shape in cross section and an intermediate plate is disposed on one end side of the valve seat member at a downstream side of the valve seat member and a nozzle plate is disposed on one end side of the intermediate plate at the downstream side of the intermediate plate, the swirl chambers and a center chamber in a bottomed recess shape being formed on one end surface of the intermediate plate and the injection holes being penetrated through the nozzle plate to the external.

15. The fuel injection valve as claimed in claim 3, wherein the characteristic of the spray angle with respect to da/d0 is set when L/d0 is 2.0, L/d0 is 1.3, and L/d0 is 0.3.

16. The fuel injection valve as claimed in claim 9, wherein a number of the swirl chambers is any one of two, three, four, and six.

17. A designing method for a fuel injection valve, the fuel injection valve comprising:

a valve body slidably installed within the fuel injection valve;

a valve seat member having a valve seat on which the valve body is seated at a time of a valve closure and having an opening section at a downstream side of the valve seat member;

a plurality of swirl generating chambers, each swirl generating chamber being configured to swirl fuel at an inner part of a corresponding one of the swirl generating chambers to provide a swirling force for fuel;

a plurality of injection holes, each injection hole being formed on a bottom section of the corresponding one of the swirl generating chambers and penetrated to an external; and a communication passage configured to communicate between the corresponding one of the swirl generating chambers and the opening section of the valve seat member, the designing method comprising:

supposing a pipe line through which fuel is uniformly caused to flow from a flow quantity of fuel flowing into each of the communication passage and, if a diameter of the pipe line is assumed to be da and a diameter of each of the injection holes is assumed to be d0, setting da/d0 such that a spray angle of the fuel injected from each of the injection holes provides a desired spray angle, and designing the communication passages and the injection holes such that at least one of fuel sprays injected from the respective injection holes is contacted on any other fuel sprays at a lower position than a liquid film part without contact of the fuel sprays injected from the respective injection holes on the liquid film parts of any other fuel sprays, wherein $$da = \sqrt{4WH/\pi}$$

wherein W denotes a width of each of the communication passages and H denotes a height of each of the communication passages.

* * * * *